US011160396B2

(12) United States Patent
Little et al.

(10) Patent No.: US 11,160,396 B2
(45) Date of Patent: Nov. 2, 2021

(54) ADJUSTABLE PILLOW

(71) Applicant: TR Products, LLC, Travelers Rest, SC (US)

(72) Inventors: John Edward Little, Travelers Rest, SC (US); Robert L. Phillips, Greenville, SC (US)

(73) Assignee: TR Products, LLC, Travelers Rest, SC (US)

( * ) Notice: Subject to any disclaimer, the term of this patent is extended or adjusted under 35 U.S.C. 154(b) by 328 days.

(21) Appl. No.: 16/114,643

(22) Filed: Aug. 28, 2018

(65) Prior Publication Data

US 2020/0069086 A1 Mar. 5, 2020

(51) Int. Cl.
*A47G 9/10* (2006.01)
*B68G 1/00* (2006.01)

(52) U.S. Cl.
CPC ..... *A47G 9/10* (2013.01); *B68G 1/00* (2013.01); *A47G 2009/1018* (2013.01); *B68G 2001/005* (2013.01)

(58) Field of Classification Search
CPC .... A47G 9/10; A47G 2009/1018; B68G 1/00; B68G 2001/005; A47C 19/027
USPC ..... 5/636
See application file for complete search history.

(56) References Cited

U.S. PATENT DOCUMENTS 1,275,205 A * 8/1918 Bigham et al. ..... A47G 9/0253 5/490
1,775,061 A * 9/1930 Gertrude ..... A47G 9/0253 5/490
2,357,789 A * 9/1944 Levy ..... A47G 9/0253 5/490
3,148,389 A 9/1964 Lustig
3,757,364 A * 9/1973 Downing ..... A47G 9/10 5/636
3,839,754 A * 10/1974 Hooper ..... A47D 7/002 5/98.2
4,185,673 A * 1/1980 Daniello ..... A45C 9/00 190/8
4,508,044 A * 4/1985 Downey ..... A47G 9/10 112/420
4,908,894 A 3/1990 Sanders
4,949,411 A 8/1990 Tesch
4,959,880 A * 10/1990 Tesch ..... A47G 9/10 5/636
5,809,594 A 9/1998 Isogai
5,953,777 A 9/1999 Buck
6,065,512 A * 5/2000 Munn, II ..... B65B 67/12 141/10
6,151,733 A 11/2000 Takashima
6,256,816 B1 * 7/2001 Law ..... A47G 9/0207 5/482
6,363,557 B2 4/2002 Chou
6,691,352 B2 2/2004 Wang
7,222,379 B2 5/2007 DiGirolamo
7,461,424 B2 12/2008 Lindell
9,462,902 B1 * 10/2016 Rukel ..... A47G 9/10
D824,190 S * 7/2018 Engelhardt ..... D6/601
(Continued)

*Primary Examiner* — Myles A Throop
(74) *Attorney, Agent, or Firm* — JK Intellectual Property Law, PA

(57) ABSTRACT

An adjustable pillow includes an inner cover defining a pocket and removable stuffing within the pocket. A related method of manufacture includes forming the inner cover having a pocket from a sheet and placing stuffing within the pocket.

12 Claims, 8 Drawing Sheets

(56) References Cited

U.S. PATENT DOCUMENTS

| | | | | |
|---|---|---|---|---|
| 10,660,461 | B1 * | 5/2020 | Chavez | B68G 1/00 |
| 2005/0177945 | A1 * | 8/2005 | Chang | A47G 9/10 5/636 |
| 2007/0245493 | A1 * | 10/2007 | Leifermann | A47G 9/10 5/636 |
| 2009/0111354 | A1 * | 4/2009 | Zheng | A63H 3/04 446/369 |
| 2013/0025053 | A1 * | 1/2013 | Vrzalik | A61G 7/057 5/495 |
| 2017/0231410 | A1 * | 8/2017 | Chon | A47G 9/10 5/640 |
| 2017/0340131 | A1 * | 11/2017 | Schmidt | A47C 27/22 |

* cited by examiner

ADJUSTABLE PILLOW

TECHNICAL FIELD

The present disclosure relates generally to an adjustable pillow and a related method of manufacture.

BACKGROUND

Users of pillows have different preferences for shape and firmness. Accordingly, many different pillow designs, shapes, materials and so forth have been proposed to meet user preferences. Meeting different preferences in a home, rental, vacation, etc., setting may thus require storage and provisioning of several different types of pillows to meet different user preferences. Such provisioning of additional or alternative pillows incurs more cost and requires more space than providing a basic (minimal required) number of pillows for each bed.

Accordingly, improvement in pillow designs and methods of manufacture of pillows could still be made to address certain drawbacks of existing devices and their related manufacturing methods, and/or provides certain other benefits to the user or manufacturer.

SUMMARY

According to certain aspects of the disclosure, an adjustable pillow may include an inner cover including a foam sheet, the foam sheet being generally rectangular and having a first edge, a second edge, a third edge and a fourth edge, the foam sheet further having a first surface and a second surface, the foam sheet including a reversing fold extending from the first edge to the fourth edge and dividing the first edge and the fourth edge into respective first portions and second portions; a pocket being formed within the inner cover via connection of the second edge to the third edge so that the first surface is substantially folded over upon itself, connection of the first portion of the first edge to the second portion of the first edge, and connection of some of the first portion of the fourth edge to the second portion of the fourth edge so as to define a pocket access opening between the first portion of the fourth edge and the second portion of the fourth edge; and stuffing located within the pocket, the stuffing including numerous independent pieces sized for removal from the pocket via the pocket access opening. Various options and modifications are possible.

For example, a tab may extend from one of the first portion or the second portion of the fourth edge for selectively closing or opening the pocket access opening. The tab may be formed unitarily with the inner cover.

The connection of the second edge to the third edge, the connection of the first portion of the first edge to the second portion of the first edge, and the connection of some of the first portion of the fourth edge to the second portion of the fourth edge may include an adhesive connection and/or a welded connection, or another type of connection.

The inner cover may be formed of a polyurethane foam, and may have a thickness between the first surface and the second surface of about 0.5 to about 2.0 inches, or about 1.5 inches. The volume of the stuffing located within the pocket may be about at least about 300 cubic inches, but also substantially less than the volume of the pocket.

The independent pieces may include polyurethane, and may be formed in angular geometric shapes, and also may be identical and have a triangular cross-section.

An outer cover may be removably located around the inner cover.

According to certain other aspects of the disclosure, a method is disclosed of manufacturing an adjustable pillow having an inner cover including a foam sheet, the foam sheet being generally rectangular and having a first edge, a second edge, a third edge, and a fourth edge, the foam sheet further having a first surface and a second surface, the foam sheet having a dividing line dividing the first edge and the fourth edge into respective first portions and second portions. The method may include the steps of folding the inner cover to form a reversing fold extending along the dividing line from the first edge to the fourth edge; forming a pocket in the inner cover by: connecting the second edge to the third edge; connecting the first portion of the first edge to the second portion of the first edge; and connecting some of the first portion of the fourth edge to the second portion of the fourth edge so as to define a pocket access opening between the first portion of the fourth edge and the second portion of the fourth edge. The method may also include placing stuffing within the pocket, the stuffing including numerous independent pieces sized for removal from the pocket via the pocket access opening. Various options and modifications are possible.

For example, the connecting steps may each include at least one of using adhesive or welding. The inner cover may include a tab extending from one of the first portion or the second portion of the fourth edge for selectively closing or opening the pocket access opening, the method further including inserting the tab into the pocket access opening to secure the stuffing within the pocket.

The method may further include removing some of the stuffing from the pocket to adjust at least one of a firmness or size of the adjustable pillow, or placing the inner cover into an outer cover. The inner cover may be formed of a polyurethane foam with a thickness is about 1.5 inches. The independent pieces may include polyurethane formed identically and each have a triangular cross-section.

BRIEF DESCRIPTION OF THE DRAWINGS

More details of the present disclosure are set forth in the drawings.

DETAILED DESCRIPTION

Figure 1:
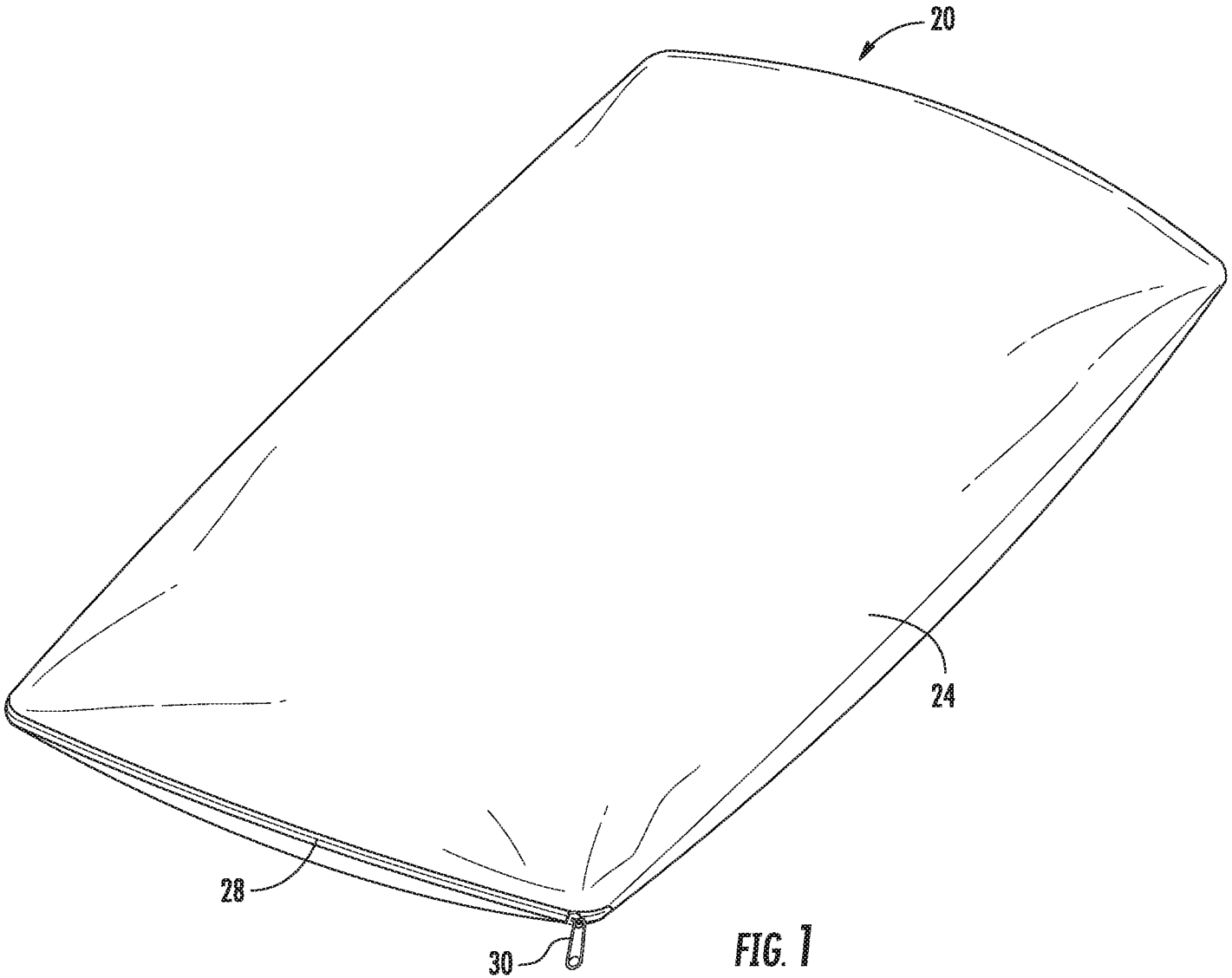
FIG. 1 is an isometric view of one example of an adjustable pillow according to certain aspects of the disclosure.

Detailed reference will now be made to the drawings in which examples embodying the present disclosure are shown. The detailed description uses numeral and letter designations to refer to features in the drawings. Like or similar designations in the drawings and description have been used to refer to like or similar parts of the disclosure.

The drawings and detailed description provide a full and enabling description of the disclosure and the manner and process of making and using it. Each embodiment is provided by way of explanation of the subject matter not limitation thereof. In fact, it will be apparent to those skilled in the art that various modifications and variations may be made to the disclosed subject matter without departing from the scope or spirit of the disclosure. For instance, features illustrated or described as part of one embodiment may be used with another embodiment to yield a still further embodiment.

Generally speaking, FIGS. 1-12 show one or more examples of an adjustable pillow 20 and methods of manufacture of an adjustable pillow incorporating certain aspects of the inventions disclosed herein. It should be understood that the pillow and manufacturing concepts disclosed herein are exemplary and have applicability beyond the scope of the examples disclosed below.

More particularly, FIGS. 1-12 show an example of an adjustable pillow 20 generally including an inner cover 22, an outer cover 24, and stuffing pieces 26. Inner cover 22 may be formed of one or more foam sheets, for example polyurethane foam.

Outer cover 24 may be formed of any suitable natural or synthetic, woven or unwoven fabric or other material, also formed from one or more sheets. If desired, an opening 28 closeable by a zipper 30 may be included within outer cover 24, for example so that outer cover may be removed and washed. However, no zipper is required, and outer cover 24 could be formed to be slid off inner cover 22, or permanently attached to inner cover 22, as long as interior pocket 32 of inner cover 22 is accessible through a portion of outer cover. Outer cover 24 may be formed from an anti-microbial or anti-allergen material, or any other material suitable for covering inner cover 22. Thus, no limitation should be made as to the type of outer cover that is used. Further, in some aspects of the disclosure, no outer cover 24 is required.

Figure 2:
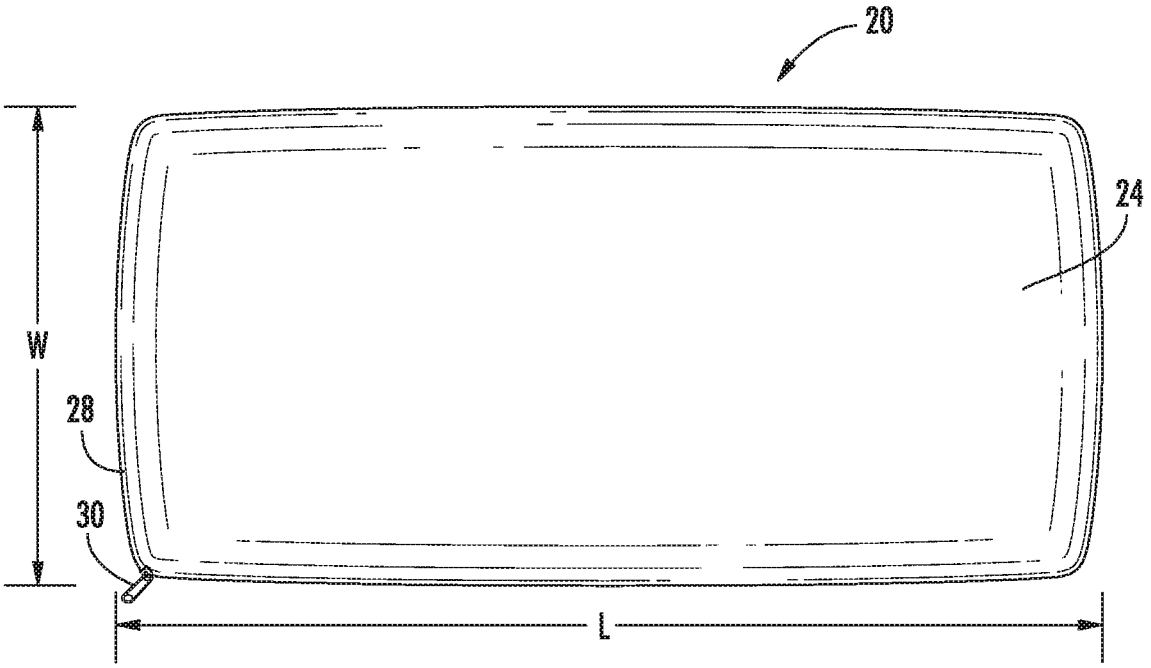
FIG. 2 is a top view of the adjustable pillow of FIG. 1.
Figure 3:
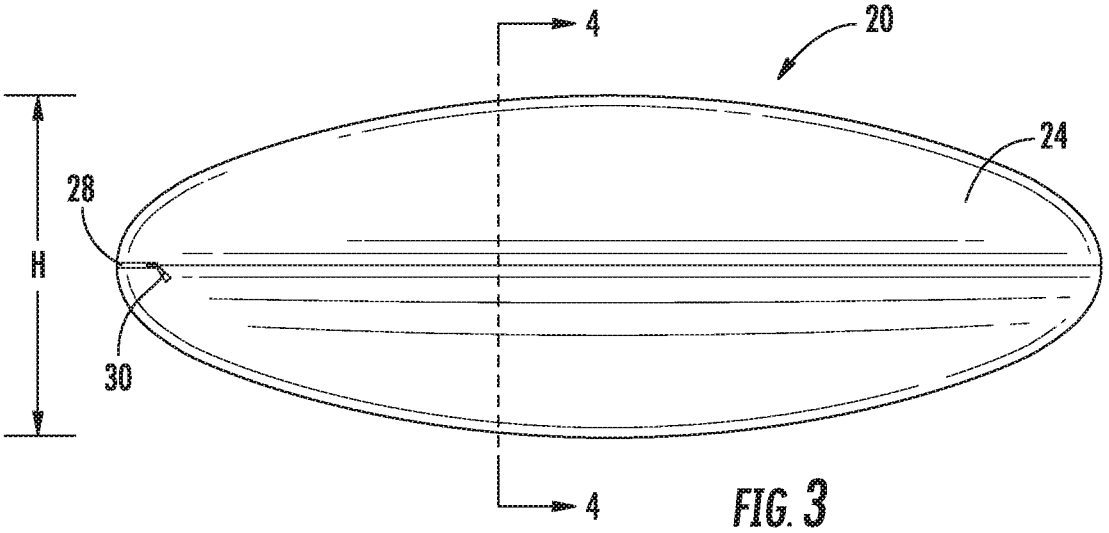
FIG. 3 is a side view of the adjustable pillow of FIG. 1.
Figure 4:
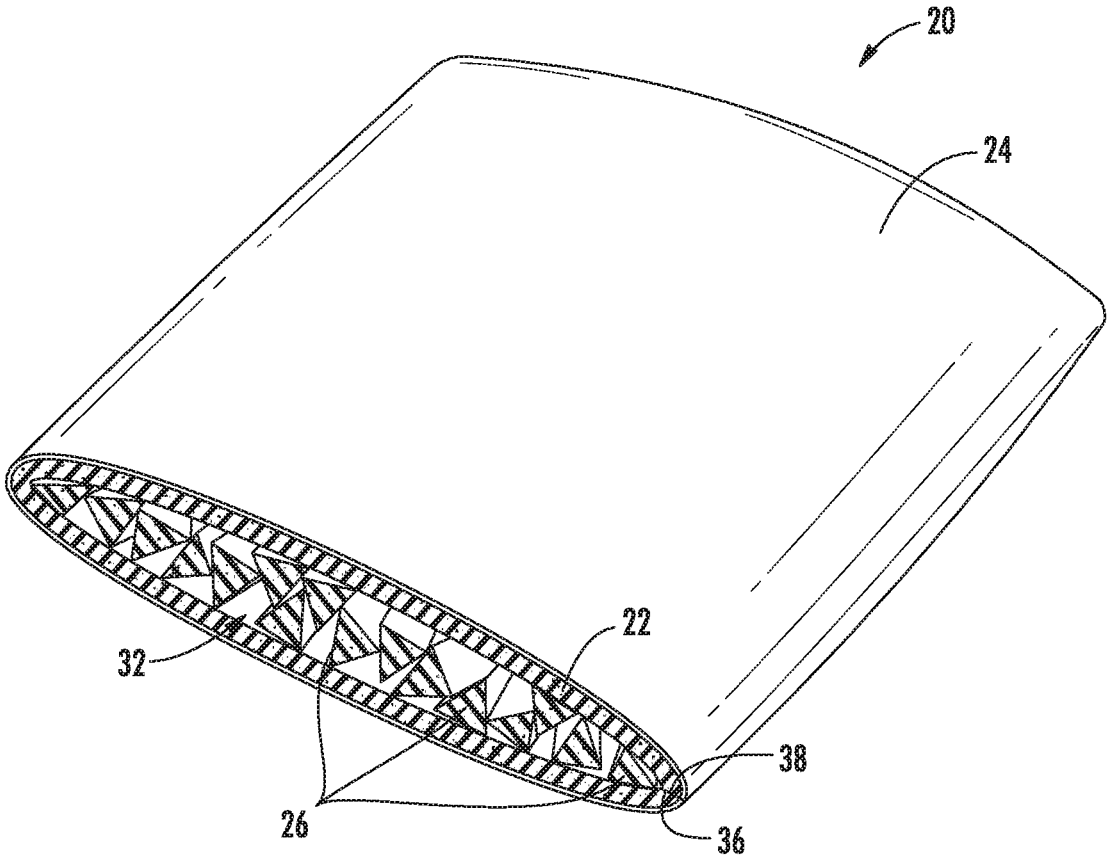
FIG. 4 is an isometric, sectional view of the adjustable pillow taken along lines 4-4 in FIG. 4.
Figure 5:
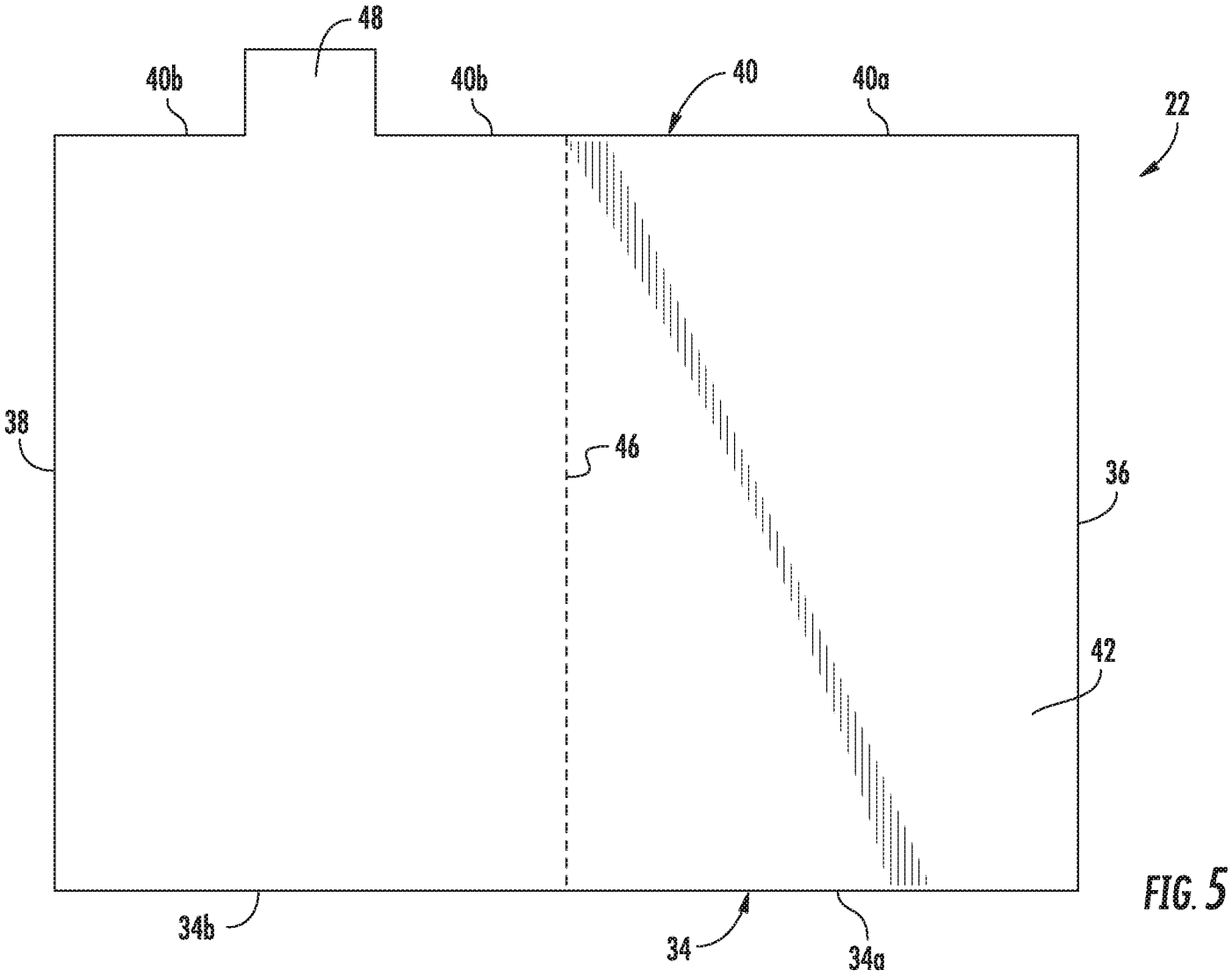
FIG. 5 is a top view of a blank used to form an inner cover of the adjustable pillow.

Adjustable pillow 20 may be made in any desired size. However, if adjustable pillow 20 is to be used for sleeping in a bed, it can be made in the conventional sizes for standard, queen, and king (U.S.) sizes, and in one example of a standard European size (which are typically square rather than rectangular). As shown in FIGS. 2 and 3, adjustable pillow has a length L, width W, and thickness T, as well as a number of stuffing pieces 26. Table 1 below, lists ranges of sizes for such pillows. Further, because the dimensions of L, W, and T for a given pillow may vary somewhat depending on an amount of stuffing pieces 26 located within interior pocket 22 (full load vs. empty load), examples of potential sizes differences based on load variations for each are also listed below. One of the benefits of the present adjustable pillow 20 is that a user may determine whether to maintain the full stuffing piece loading (e.g., 200, 240, 280 pieces), remove some or all of the pieces, or even insert more than the full amount listed, at user comfort and discretion.

TABLE 1

| Pillow Sizes (in inches) | | | | | |
|---|---|---|---|---|---|
| Size | Fill Amount | L | W | T | Pieces |
| Standard | Full | 26 | 20 | 10 | 200 |
| Standard | Empty | 27 | 21 | 3 | 0 |
| Queen | Full | 30 | 20 | 10 | 240 |
| Queen | Empty | 31 | 21 | 3 | 0 |
| King | Full | 36 | 30 | 10 | 280 |
| King | Empty | 37 | 31 | 3 | 0 |
| Europe | Full | 26 | 26 | 10 | 240 |
| Europe | Empty | 27 | 27 | 3 | 0 |

Note that the actual dimensions given above are simply prophetic examples set forth for illustrative purposes. A "Full" pillow, as described below, is fully stuffed with stuffing pieces and "plumper," whereas an "Empty" pillow has all stuffing pieces removed, rendering the pillow flatter (essentially twice the thickness of inner cover 22) and slightly more spread out in the L and W dimensions. It should be understood that the above examples are simply for illustrative purposes to show general concepts regarding sizing and loading, and that none of the noted dimensions are limiting. An example is set forth below with a particular size, but that should be considered exemplary only, as illustrative of certain concepts rather than providing dimensional limitations.

Inner cover 22 may be formed from a single, generally rectangular foam sheet having a first edge 34, a second edge 36, a third edge 38, a fourth edge 40, a first surface 42, and a second surface 44. The foam sheet used to make inner cover 22 may have a thickness between surfaces 42 and 44 of about 0.5 inches to about 2.0 inches, and preferably about 1.5 inches.

Inner cover 22 is formed from the foam sheet via a reversing fold 46 extending between edges 34 and 40, and thereby dividing the first edge 34 and the fourth edge 40 into respective first portions 34*a*, 40*a* and second portions 34*b*, 40*b*. As discussed below, a tab 48 extends from fourth edge 40.

Figure 6:
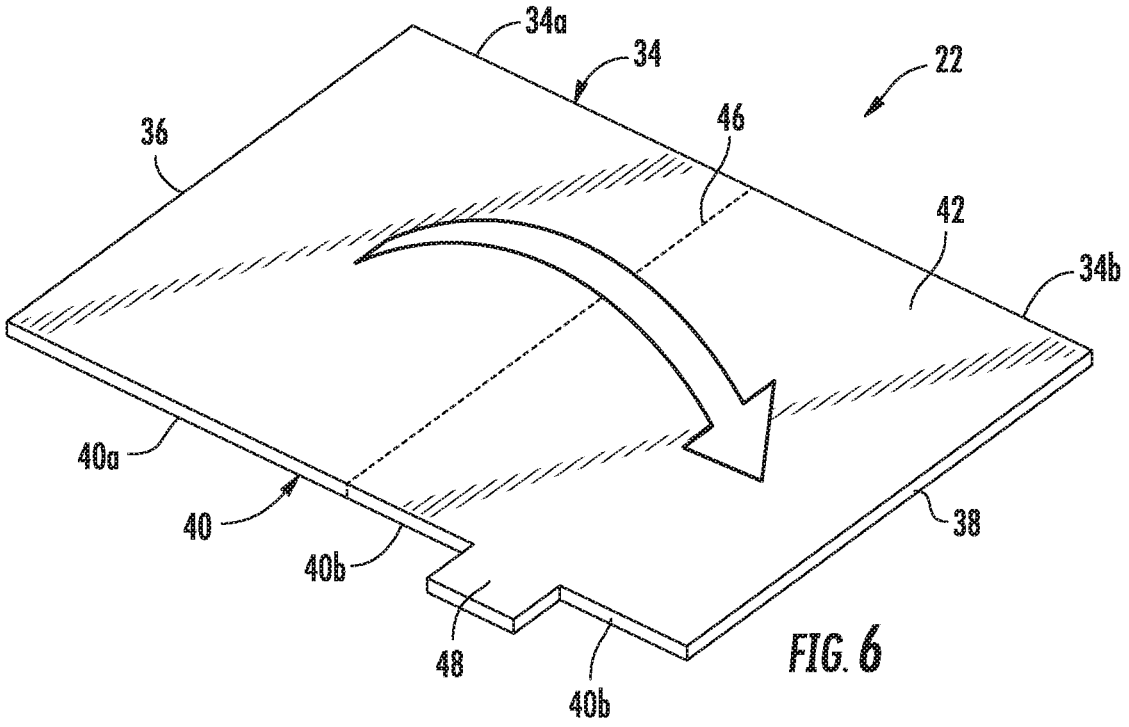
FIG. 6 is an isometric view of the blank showing a first step in forming the inner cover.
Figure 7:
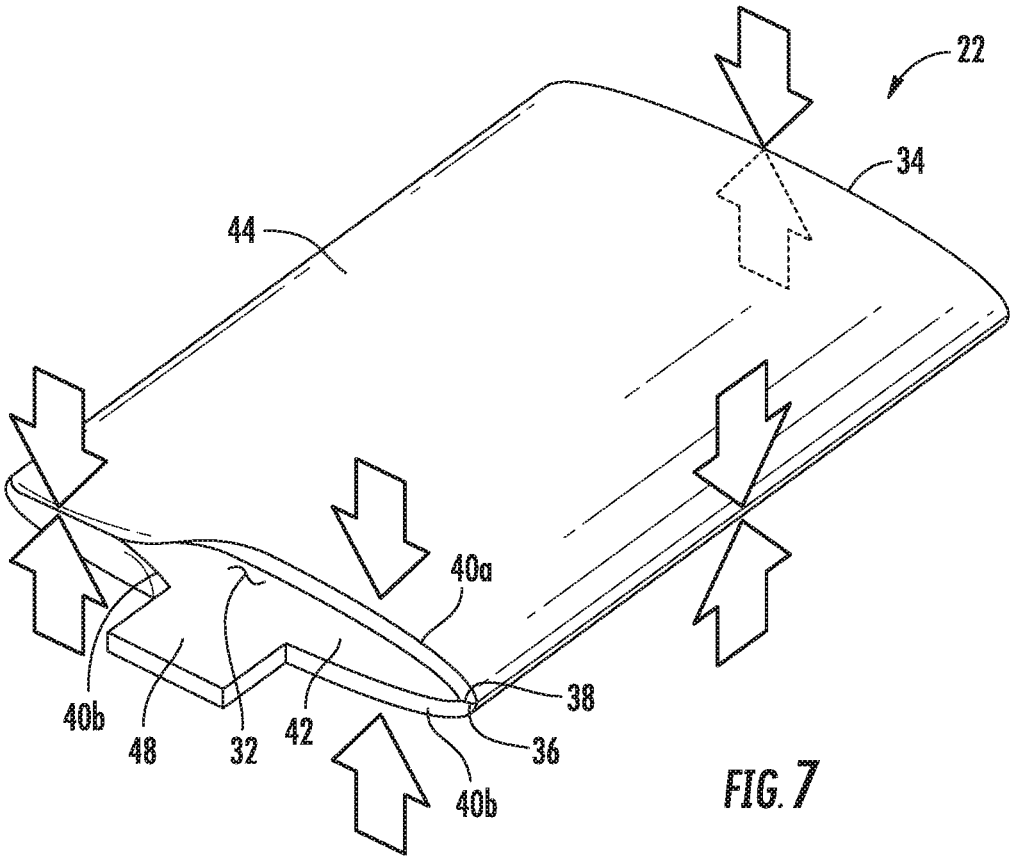
FIG. 7 is an isometric view as in FIG. 6 showing further steps in forming the inner cover.
Figure 8:
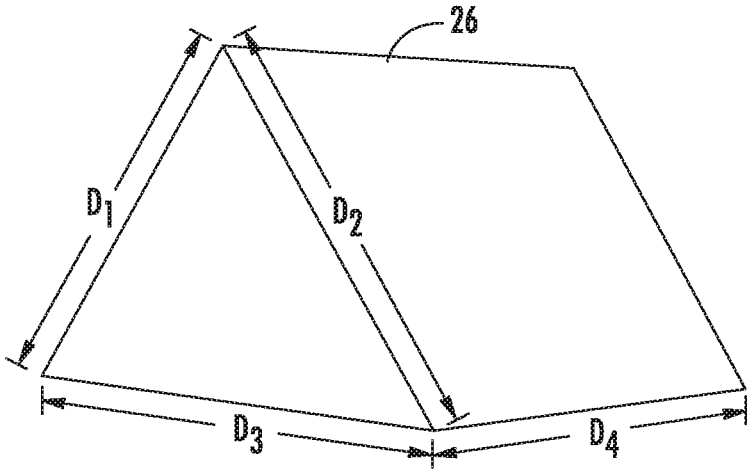
FIG. 8 is an isometric view of a stuffing element to be placed in or removed from the inner cover.
Figure 9:
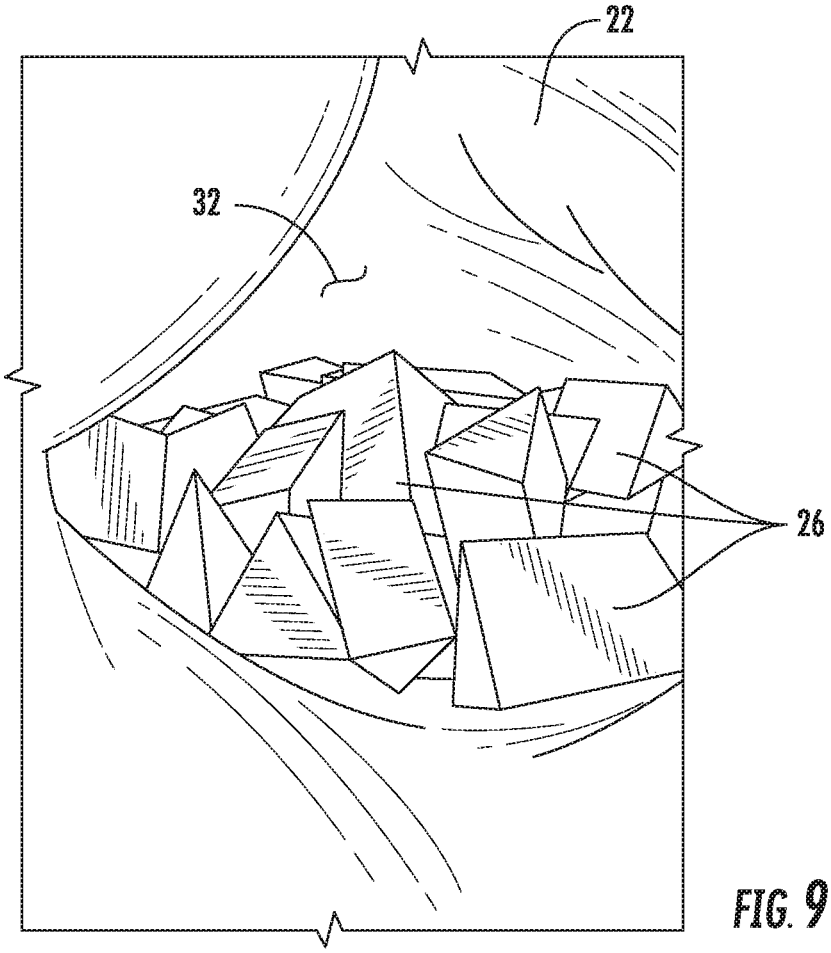
FIG. 9 is a side view looking into a pocket in the inner cover holding a number of the stuffing elements.

As shown in FIG. 6, pocket 32 is formed within inner cover 22 via connection of second edge 36 to third edge 38, so that first surface 42 is substantially folded over upon itself, as well as connection of first portion 34*a* to second portion 34*b* of first edge 34, and connection of some of first portion 40*a* to second portion 40*b* of fourth edge 40. Such incomplete connection along fourth edge 40 defines a pocket access opening 50 between first and second portions 40*a*, 40*b* of fourth edge 40, generally opposite and generally as wide as a tab 48 extending from portion 40*b*.

Edges 36/38, and portions 34*a*/34*b* and 40*a*/40*b* may be secured via an adhesive, an epoxy, by hot welding, sonic welding, stitching, interlocks, connectors, snaps, clips, or any other desired connection. Use of adhesive or welding provides a uniform connection along joined edges, and connection so that the edges/portions contact each other (rather than having surface 42 contact itself along such edges/portions) provides a "plumper" shape suited to use as a pillow.

However, other connection arrangements could be employed between edges/portions and/or surface 42.

Figure 10:
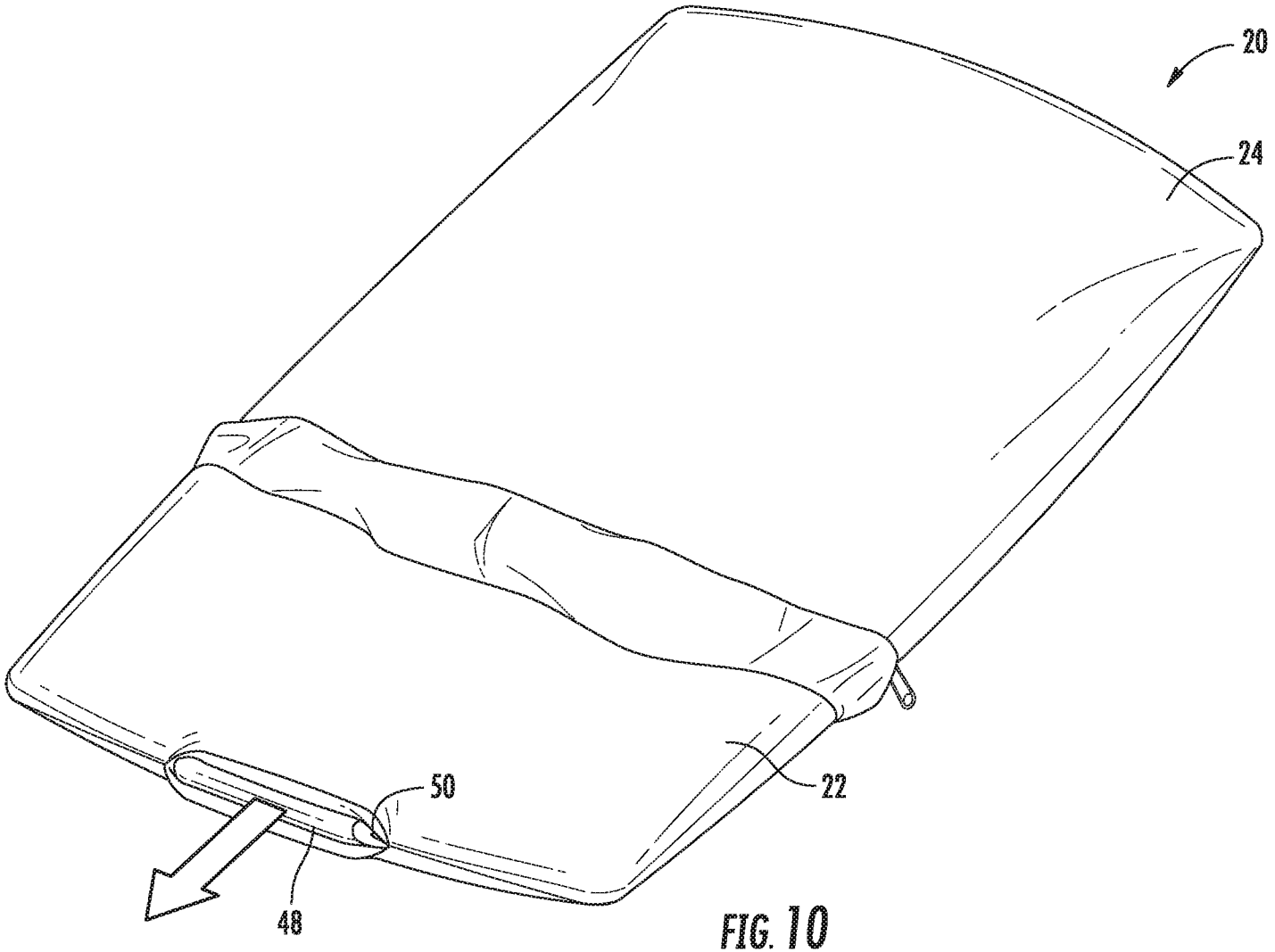
FIG. 10 is an isometric view showing steps for adjusting the adjustable pillow.
Figure 11:
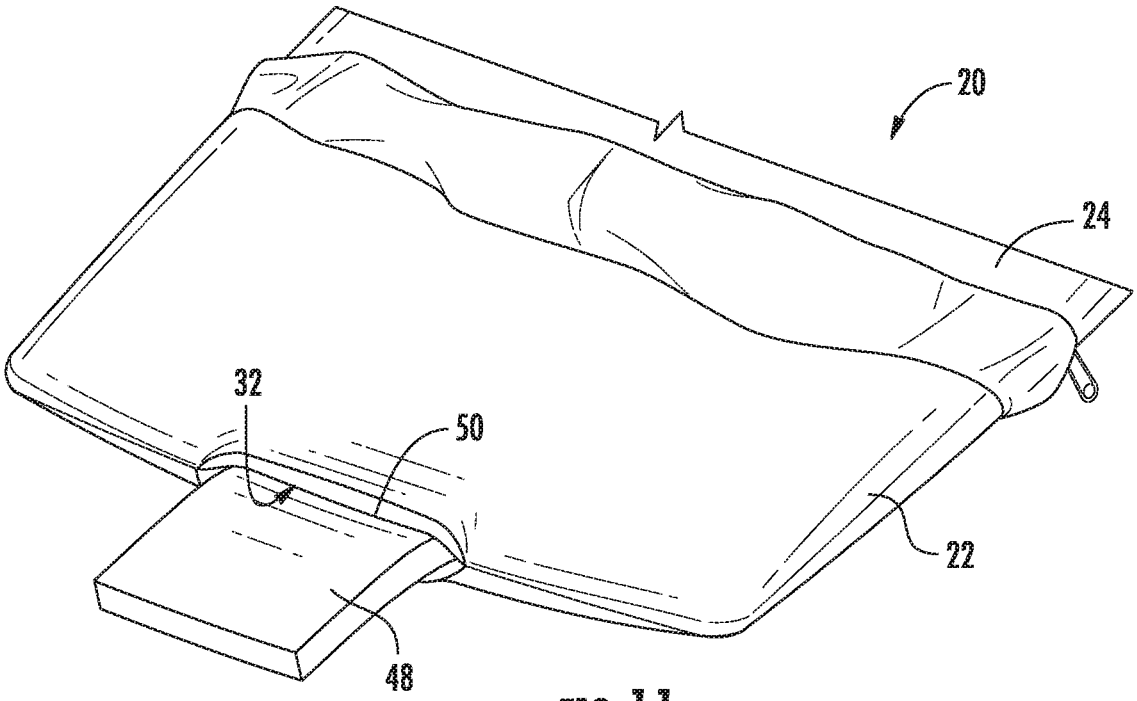
FIG. 11 is an isometric view as in FIG. 10 showing further steps for adjusting the adjustable pillow.
Figure 12:
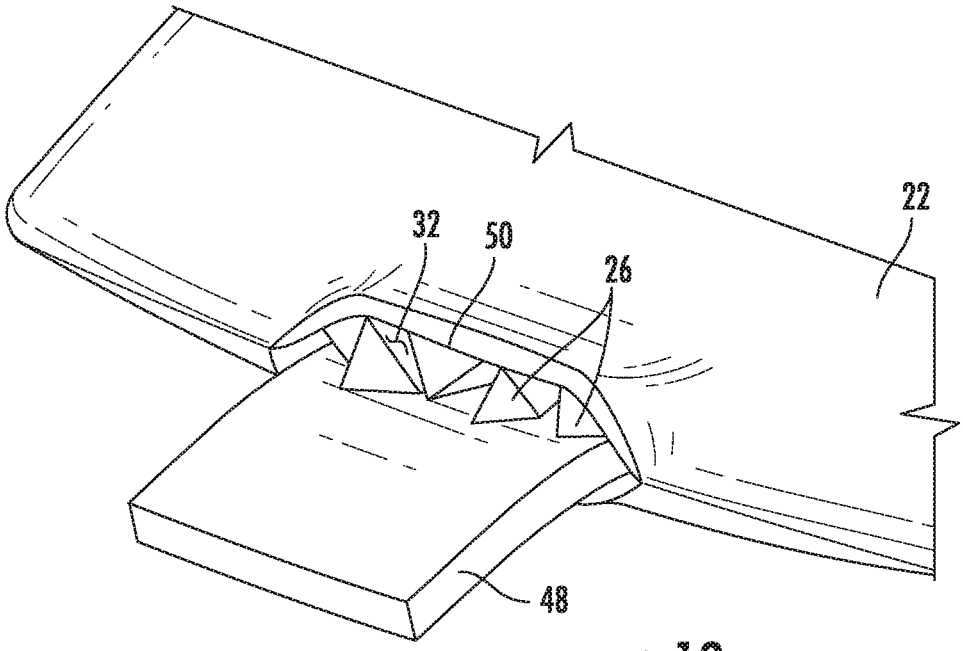
FIG. 12 is an isometric view as in FIG. 10 showing still further steps for adjusting the adjustable pillow.

Tab 48 is an optional closure element for pocket access opening 50 when placed into such opening (FIG. 10). Access to pocket 32 may be selectively provided by unfolding end extending tab 48 outward (FIGS. 11 and 12). Access to pocket 32 may be provided to initially fill pocket with stuffing pieces 26, or later to adjust the firmness of pillow by inserting more pieces or removing some of the pieces. After filling or adjustment, pocket 32 may be reclosed by folding tab 48 over and stuffing it into pocket access opening 50.

As illustrated, tab 48 is formed unitarily with the sheet forming inner cover 22, but tab 48 could be formed separately and attached. Assuming pillow 20 is one of the standard sizes above, tab 48 and opening 50 should have a width of about 4.0 to about 6.0 inches, so as to allow comfortable placement of a user's hand inside of opening 50 to manipulate pieces 26 when desired. Tab may extend outward a generally similar distance so as to provide a suitable closure when inserted into opening 50. Tab 48 and opening 50 should not be so large as to compromise the integrity of the pillow (causing it to compart or leak pieces 26 when not desired), but various sizes and proportions and acceptable for tab 48 and opening 50.

Stuffing pieces 26 may be numerous independent pieces sized for removal from pocket 32 via pocket access opening 50 by a user. Typically, a pillow would be sold "full" so the pillow is firm and plump, and a user could open opening and remove some of the pieces to change the fullness and firmness. However, inner cover 22 could be shipped empty, with the stuffing pieces separately packaged, and the user could insert a desired number (rather than removing some) to achieve a desired firmness or plumpness.

Pieces 26 have generally regular angular geometric shapes made of polyurethane foam. For example, as shown, pieces are identical and have a triangular cross-section with a dimension D1 and D2 (which may be at right angles as illustrated for convenience of manufacture) of about 1.0 to about 2.0 inches, preferably about 1.5 inches, a dimension D3 of the square root of $D1^2$ plus $D2^2$ (2.12 inches if D1 and D2 are 1.5 inches), a dimension D4 of about 1.0 to about 2.0 inches, and preferably about 1.5 inches.

It has been determined that providing uniform triangular pieces with such dimensions provides a comfortable compression, a comfortable firmness, and stable grip between the pieces so that the pillow retains a desired shape. In other words, the compressible foam and surface friction generated between contacting pieces and their interacting surfaces provides for a comfortable pillow that maintains its shape in ways that other pillow interior fills (feathers, shredded material, smaller pieces, etc.) do not. Also, inner surface 42 of inner cover 22 provides similar mild frictional contact with pieces 26 that also helps retain the desired pillow shape while still being comfortable and breathable.

A volume of each stuffing piece 26 with dimensions of 1.5×1.5×2.12×1.5 as above is about 1.69 cubic inches. Due to the irregular shape of the pieces 26 and some inherent rigidity provided by inner cover 22 with its reversing fold 46 and 1.5 inch thick edge bonding, a substantial amount of empty space (filled by air) exists between inner surface 42 and pieces 26. The full interior dimension of inner a standard sized pillow cover pocket 32 may thus be as high as about 600, 800, or as much as 1000 cubic inches (depending at least in part on firmness and thickness of inner cover 22), but it may be filled comfortably with 200 pieces of about 1.69 cubic inches each, thus adding up to about 340 total cubic inches of foam within the larger pocket. Thus, only a fraction of the volume of pocket 32 (using examples above) is filled by foam pieces 26. If pieces are larger, than the fill could be firmer, or fewer pieces could be used, per comfort preference. Thus, as noted above, use of 200 pieces 26 dimensioned as above indicates one example of a subjective "full" load, although substantial spacing does exist between pieces and inner cover 22. However, depending on the compressibility and size of pieces 26 used or desired for comfort, other piece volumes and numbers could be employed. Comfort is of course subjective, and the present designs allow for essentially infinite adjustability in that regard.

In other aspects, the disclosure relates to a method of manufacturing an adjustable pillow along the above lines and having an inner cover including a foam sheet, the foam sheet being generally rectangular and having a first edge, a second edge, a third edge, and a fourth edge, the foam sheet further having a first surface and a second surface, the foam sheet having a dividing line dividing the first edge and the fourth edge into respective first portions and second portions. The method may include steps such as: folding the inner cover to form a reversing fold extending along the dividing line from the first edge to the fourth edge; forming a pocket in the inner cover by: connecting the second edge to the third edge; connecting the first portion of the first edge to the second portion of the first edge; and connecting some of the first portion of the fourth edge to the second portion of the fourth edge so as to define a pocket access opening between the first portion of the fourth edge and the second portion of the fourth edge. The method may also include placing stuffing within the pocket, the stuffing including numerous independent pieces sized for removal from the pocket via the pocket access opening.

Once manufactured, the pillow may be adjusted by inserting into or removing from the pocket some stuffing so as to adjust at least one of a firmness or size of the adjustable pillow.

Accordingly, an adjustable pillow and related method of manufacture are disclosed. While preferred embodiments of the invention have been described above, it is to be understood that any and all equivalent realizations of the present invention are included within the scope and spirit thereof. Thus, the embodiments depicted are presented by way of example only and are not intended as limitations upon the present invention. Thus, while particular embodiments of the invention have been described and shown, it will be understood by those of ordinary skill in this art that the present invention is not limited thereto since many modifications can be made. Therefore, it is contemplated that any and all such embodiments are included in the present invention as may fall within the literal or equivalent scope of the appended claims.

We claim:

1. An adjustable pillow, comprising:

an inner cover including a foam sheet, the foam sheet being generally rectangular and having a first edge, a second edge, a third edge and a fourth edge, the foam sheet further having a first surface and a second surface, the foam sheet including a reversing fold extending from the first edge to the fourth edge and dividing the first edge and the fourth edge into respective first portions and second portions;

a tab extending from one of the first portion or the second portion of the fourth edge;

a pocket being formed within the inner cover via connection of the second edge to the third edge so that the first surface is substantially folded over upon itself, connection of the first portion of the first edge to the second portion of the first edge, and connection of some of the first portion of the fourth edge to the second portion of the fourth edge so as to define a pocket access opening between the first portion of the fourth edge and the second portion of the fourth edge, the tab being positionable to selectively close or open the pocket access opening; and stuffing located within the pocket, the stuffing including numerous independent pieces sized for removal from the pocket via the pocket access opening.

2. The adjustable pillow of claim 1, wherein the tab is formed unitarily with the inner cover.

3. The adjustable pillow of claim 1, wherein the connection of the second edge to the third edge, the connection of the first portion of the first edge to the second portion of the first edge, and the connection of some of the first portion of the fourth edge to the second portion of the fourth edge includes an adhesive connection.

4. The adjustable pillow of claim 1, wherein the connection of the second edge to the third edge, the connection of the first portion of the first edge to the second portion of the first edge, and the connection of some of the first portion of the fourth edge to the second portion of the fourth edge includes a welded connection.

5. The adjustable pillow of claim 1, wherein the inner cover is formed of a polyurethane foam.

6. The adjustable pillow of claim 1, wherein the inner cover has a thickness between the first surface and the second surface of 0.5 to 2.0 inches.

7. The adjustable pillow of claim 1, wherein the inner cover thickness is about 1.5 inches.

8. The adjustable pillow of claim 1, wherein the volume of the stuffing located within the pocket is at least 300 cubic inches but is substantially less than a volume of the pocket.

9. The adjustable pillow of claim 1, further including an outer cover removably located around the inner cover.

10. The adjustable pillow of claim 1, wherein the independent pieces include polyurethane.

11. The adjustable pillow of claim 10, wherein the independent pieces are formed in angular geometric shapes.

12. The adjustable pillow of claim 10, wherein the independent pieces are identical and have a triangular cross-section.

* * * * *